US011408196B2

(12) United States Patent
Cogburn

(10) Patent No.: US 11,408,196 B2
(45) Date of Patent: Aug. 9, 2022

(54) CHANNELED FENCE POST FOR BUILDING HORIZONTAL FENCE, METHOD OF CREATING HORIZONTAL FENCE AND METHOD FOR MANUFACTURE OF FENCE POST

(71) Applicant: Melanie Jo Cogburn, Austin, TX (US)

(72) Inventor: Melanie Jo Cogburn, Austin, TX (US)

( * ) Notice: Subject to any disclaimer, the term of this patent is extended or adjusted under 35 U.S.C. 154(b) by 0 days.

(21) Appl. No.: 16/886,361

(22) Filed: May 28, 2020

(65) Prior Publication Data

US 2020/0378149 A1 Dec. 3, 2020

Related U.S. Application Data

(60) Provisional application No. 62/853,922, filed on May 29, 2019.

(51) Int. Cl.
*E04H 17/20* (2006.01)
*E04H 17/16* (2006.01)
*E04H 17/14* (2006.01)

(52) U.S. Cl.
CPC ..... *E04H 17/20* (2013.01); *E04H 17/1417* (2013.01); *E04H 17/1447* (2021.01); *E04H 17/168* (2013.01)

(58) Field of Classification Search
CPC ... E04H 17/20; E04H 17/1417; E04H 17/168; E04H 17/166; E04H 17/165; E04H 17/006; E04H 17/1447
USPC ..... 52/837
See application file for complete search history.

(56) References Cited

U.S. PATENT DOCUMENTS 991,603 A * 5/1911 Brooks ..... E04C 3/07 52/364
2,584,194 A * 2/1952 Drury ..... E04B 2/58 52/377
2,723,107 A * 11/1955 Parker ..... E04H 17/20 256/24
3,193,255 A * 7/1965 Burdett ..... E04H 17/18 256/19
3,328,931 A * 7/1967 Smith ..... E04C 3/07 52/299
4,953,339 A * 9/1990 Jewell ..... E04B 1/003 52/837
7,628,386 B2 * 12/2009 Payne ..... E04H 17/161 256/47
7,866,635 B2 * 1/2011 Payne ..... E04H 17/04 256/24
8,382,070 B1 * 2/2013 Gibbs ..... E04H 17/143 256/65.02
8,720,866 B1 * 5/2014 Gibbs ..... E04H 17/1447 256/65.02
8,783,661 B1 * 7/2014 Payne ..... E04H 17/168 256/49
9,004,342 B2 * 4/2015 Gallagher, Jr. ..... C22C 38/14 228/173.6
10,577,825 B1 * 3/2020 Givens ..... E04H 17/1447
10,604,962 B1 * 3/2020 Givens ..... E04F 11/1855
10,767,325 B2 * 9/2020 Humphries ..... E01F 15/088
(Continued)

*Primary Examiner* — Brent W Herring
(74) *Attorney, Agent, or Firm* — Matthew E. Burr

(57) ABSTRACT

A channeled fence post system and method is provided for building horizontal fencing. 2 J-channeled metal posts are attached back to back and provide holes through which boards can be mounted horizontally with the mounting connectors hidden from the front face of the fence.

13 Claims, 10 Drawing Sheets

(56) References Cited

U.S. PATENT DOCUMENTS

| | | | | |
|---|---|---|---|---|
| 2007/0145340 | A1* | 6/2007 | Brabeck | E04H 17/168 256/24 |
| 2007/0221901 | A1* | 9/2007 | Salzer | E04H 17/168 256/21 |
| 2007/0272909 | A1* | 11/2007 | Payne | E04H 17/168 256/47 |
| 2014/0061417 | A1* | 3/2014 | Maisch | E04B 9/16 248/327 |
| 2015/0041743 | A1* | 2/2015 | Richison | E04H 17/1417 256/24 |
| 2020/0399925 | A1* | 12/2020 | Naylor | E04H 17/1456 |

* cited by examiner

CHANNELED FENCE POST FOR BUILDING HORIZONTAL FENCE, METHOD OF CREATING HORIZONTAL FENCE AND METHOD FOR MANUFACTURE OF FENCE POST

CROSS-REFERENCE TO RELATED APPLICATIONS

This application is related to, is a continuation-in-part of, and claims priority from U.S. provisional application Ser. No. 62/853,922, filed May 29, 2019, by the same inventor, the disclosure of which is incorporate herein by reference.

FIELD OF THE INVENTION

The invention relates generally to channeled fence post for building horizontal fence, several methods for constructing a horizontal wood fence, and method of manufacturing a metal fence post.

BACKGROUND

Currently there are a number of solutions for construction of a horizontal wood fence. The traditional method is to use wood posts, wherein horizontal wood boards are fixed directly into the wood post, but the wood post is prone to rot and decay. To combat this problem, metal posts have been used to create horizontal fences, each also having limitations. Round metal posts can be used with clips to affix support boards and the horizontal boards are fastened to support boards. However, the use of round metal posts is not aesthetically pleasing, are not "good neighbor" fences as one side will feature unattractive metal posts and the other side will not, and the posts cannot be easily hidden. The support boards can also rot and decay and are cumbersome method of construction. The other method is to use a square metal post, and sandwich two support boards on the side of that metal post, which are drilled into the metal post, and affix horizontal boards to the support boards. However, the aesthetics again are not as pleasing because there is no way to hide the metal post, and support boards have to be drilled into the square post which is cumbersome. The wood support posts are also prone to rot and decay. Another method is to use the Halco postmaster to construct a horizontal wood fence, which is a hat channel metal post. However, construction is cumbersome. Like using a square metal post, wood support boards have to be fastened to the post, and horizontal boards then are attached to the support boards. Another design is the "slipfence", which has metal U channels that affix to a metal square post or a wood post, with boards that slide into the U channels. However, this solution again does not allow the metal post or the channel posts to be hidden and the construction is cumbersome, the metal post and u channels are very noticeable which may not be aesthetically pleasing. None of the solutions avoid the necessity of wood support boards or allow the post to be hidden, nor do any of these solutions allow an alternative construction where all fasteners and all posts are hidden.

SUMMARY OF THE INVENTION

The present invention relates to (1) an improved metal fence post (2) improved method for construction of a fence in which fence boards are positioned horizontally, and (3) and a method for manufacture of a metal fence post. Metal is a preferred material, but the present invention contemplates specific alternative embodiments having non-metallic materials. With respect to the device, it is preferably a metal fence post constructed of 2 back facing metal J channels, which allows for the easy construction of a horizontal wood fence in multiple designs. Each J-channel post is shaped to have a long arm and a short arm which form a channel between them. Back-to-back connection of the J-channel posts means they are connected such that the short arms are one a first side and the long arms are on a second side. Additional decorative panels can be clipped onto the post after the wood boards are placed in the channel. This metal fence post is superior to traditional methods of constructing horizontal wood fences which require the use of wood posts or round metal posts. The core components of the invention are two J channel metal posts, which are positioned back to back, and are permanently fastened together, and which have holes along the post used to fasten boards along the post. With respect to the device it should be further noted that once the two J channels are fastened together, a metal post is created with two planes of faces of different widths. The difference in the widths of the front face and back face allows greater flexibility in positioning the boards in the channel, and also allows the user the space to maneuver the drill to fasten boards easily to the face of the post, to achieve a fence with hidden fasteners. Specifically, a wood board can be fastened directly to the face of the post, by back drilling into the board with a fastener. A further advantage of the present fencing system is that it provides a modular post to which fence boards and decorative covers can be selectively attached to a front side, a rear side and in the channels of the posts.

With respect to the associated method for construction of a horizontal fence, In order to carry out the method the following core steps are followed: the metal post is secured into the ground along the proposed fence line. Wood boards are slid into the channels and fastened with screws. The boards can be adjusted vertically while in the channel before they are fastened, to achieve different designs created by spacing the boards as the user sees fit. The post is then covered with a decorative metal strip, with attaches with a clip or other method, to cover the post and the fasteners attached to the post or can be covered with a narrow wood board placed vertically. Alternatively, a horizontal fence can be created by placing a wood board horizontally on the face of the post (and not inside the channel) then fastening the wood board from behind, such that the screws are not visible from the front of the fence. A fence with hidden fasteners is very desirable with high end woods such as Ipe so that the beauty of the wood is not marred by the appearance of fasteners. Ultimately, at the conclusion of these steps, a horizontal fence is created on metal posts, which is superior in stability to wood posts.

It is desirable to have a device that supports the creation of a horizontal wood fence that is stable and resistant to rot. Furthermore, it would also be desirable to have a device that allows for the wood boards to placed inside the channel where they can be easily fastened or adjusted vertically for decorative effect, and further where decorative panel could be applied over the post for a seamless appearance that obscures the fasteners and the post. Still further, it would be desirable to have a device that also allows a horizontal fence to be created with hidden fasteners. The disclosed device and associated method advantageously fill these need and addresses the aforementioned deficiencies by providing a multi-functional metal post, superior to wood posts, that allows wood boards to be placed in the channel which is then covered in several ways, but which also allows the user to create fence where all fasteners are hidden on at least one side, by placing the boards outside the channel on the face of the post, where screws are fastened from behind.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Channeled Fence Post for Building Horizontal Fence and Method of Creating Same may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION

The present invention is directed to a channeled fence post for building horizontal fence and method of creating same.

In its most complete form, the device is made up of the following components: two J channel metal posts joined to form a dual channeled unitary post, with holes punched in the posts, and a decorative panel that fasten onto the post. The most complete form of performing the method associated with the disclosed device consists of the following steps: two J Channel posts are formed out of metal, then fastened back to back through rivets or laser welding, such that two faces are formed—a front face, and a back face that is wider than the front face, with two channels created between and a perpendicular plane. A horizontal wood fence is then constructed by placing wood boards is the channels and fastening them with screws. A decorative cover panel is then optionally fastened to the post to cover the screws. For simplicity the fence member will mostly be referred to as a "board," typically of wood. However, it will be understood that any suitable planar member can be use to create a fence, including in addition to wood materials such as plastic, resin, composite, metal and so forth. To acknowledge the diversity of suitable materials, the term "backing member" may be used herein to refer to a board that is fastened to the post or disposed within the channel of the posts. Similarly, although a post of the present fencing system is described herein as being made of metal, it will be understood a suitable non-metallic material can be used, including plastic, wood, composite and so on.

Figure 1:
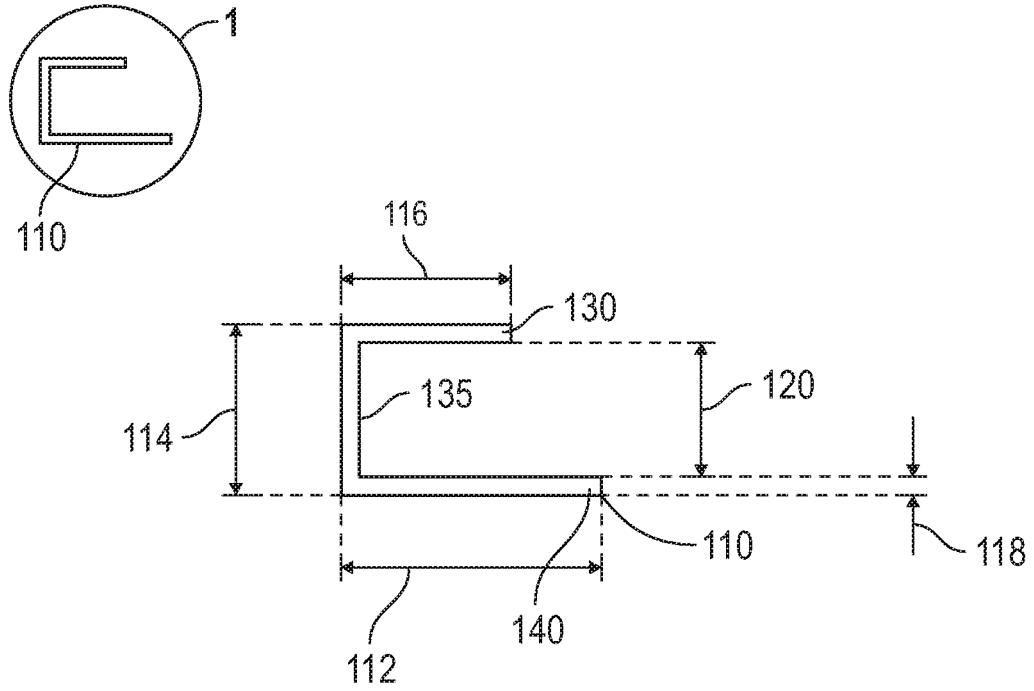
FIG. 1 is the profile top view of a single J Channel piece and a dimensional detail breakout.

FIG. 1 shows a profile side view a specific exemplary embodiment of a J channel post 110 of the present invention. Post 110 has a short arm 130 and a long arm 140 joined by connecting segment 135 to form the shape of the letter "J." A detail breakout of FIG. 1 illustrates length 112 of the longer arm of the J channel post being longer than the length of the shorter arm 116. The difference between exterior depth 114 and interior width 120 yields a uniform size 118. Alternative embodiments contemplate a tapered or widening shape of either the long arm 112 or the short arm 116 of a J channel post.

Figure 2:
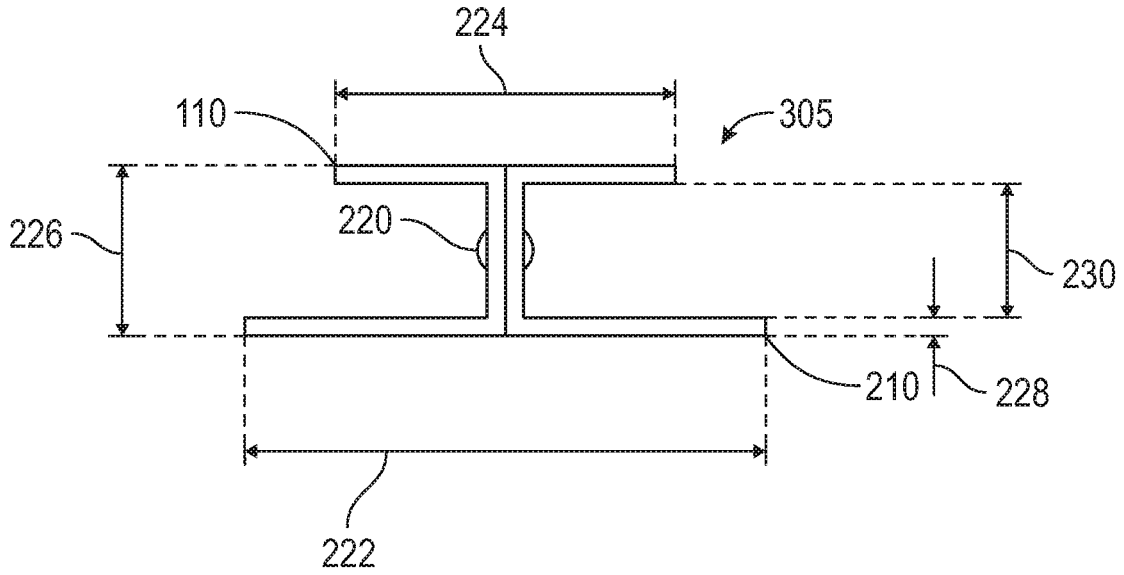
FIG. 2 is the profile stop view of the two J Channel pieces fastened together.

FIG. 2 shows a profile view of 2 J channel posts fastened back to back form post 305 having two channels. Post 110 and post 210 are join by connector 220, such as for example a rivet or welding bead that connects post 110 and 120 along the connecting segment 135 for each post 110, 120, respectively, to form a unified post 305. The combined length of the long arms is distance 222 and the combined length of the short arms is distance 224. Exterior dimension 226 and interior dimension 230 yield uniform size 228 for the joined posts.

Figure 3A:
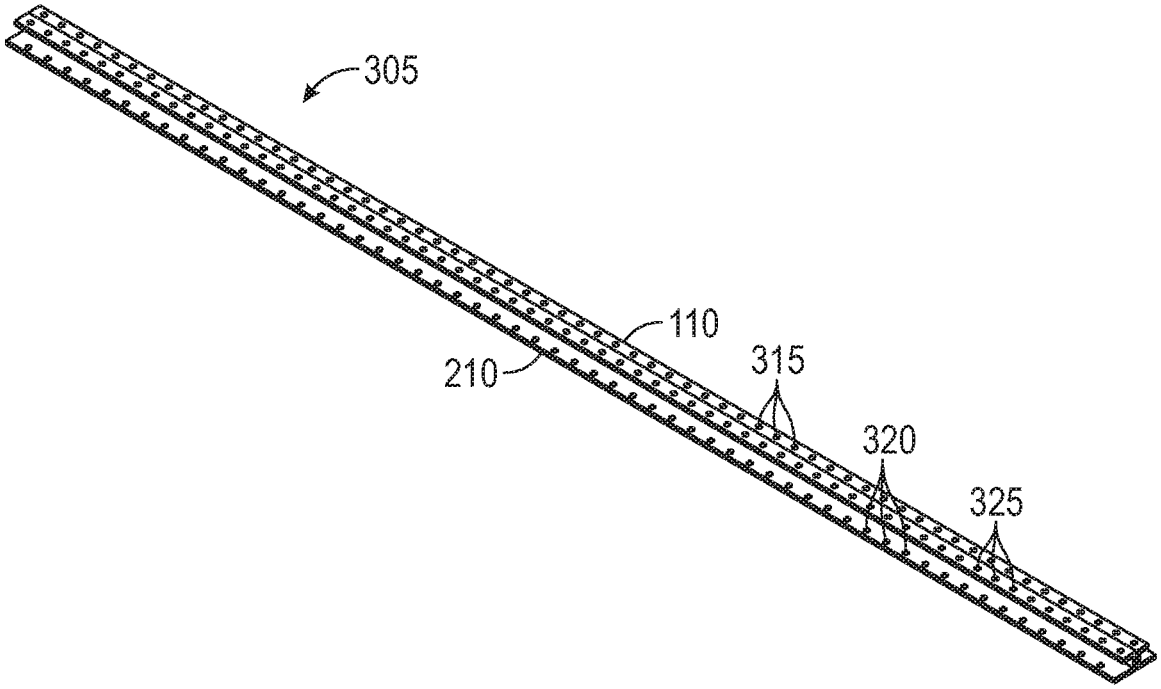
FIG. 3A is an isometric perspective view of a specific exemplary embodiment of joined J channel posts of the invention.

FIG. 3A is an isometric perspective view of a specific exemplary embodiment of joined J channel posts formed to make a complete post, where the two J channels are fastened back to back by rivets, screws, welds of other suitable connection, with holes punched along the vertical of the post. Post 110 is joined to post 210 to form unified post 305. Short arm 130 is perforated with a plurality of guide holes 315. Long arm 140 is perforated with a plurality of guides 325.

Figure 3B:
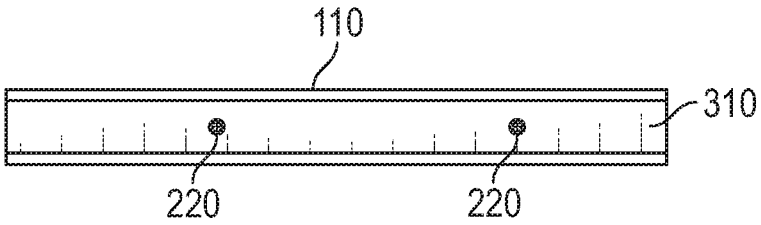
FIG. 3B is a diagrammatic illustration side view of a channel of a J channel post of the present invention.

FIG. 3B is a top view diagrammatic illustration of J channel post 110 channel 310. Connectors 220, such as rivets, screws, welds of other suitable connector attaches post 110 to post 120 (not visible in this view). One or more fence boards, or, broadly speaking, backing members, can be disposed in the channel of the posts by sliding the backing member down the channel from the top of the post. In this way, fence boards can be sequentially stacked to create a fence.

Figure 3C:
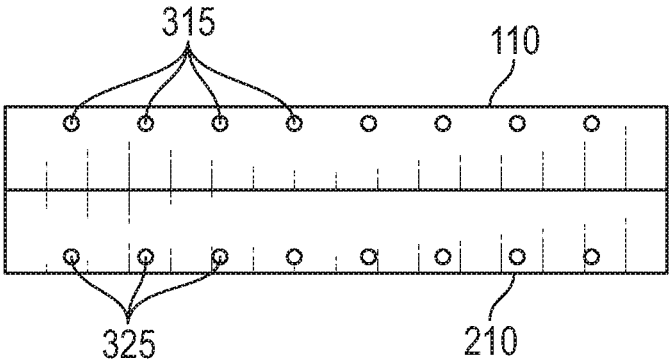
FIG. 3C is a diagrammatic illustration of detail of a surface of two joined J channel posts.

FIG. 3C is a side view diagrammatic illustration of a detail of a surface of two joined J channel posts. Guide holes 315 of post 110 and guide holes 325 of post 120 are provide along the short arm 130 of each of post 110 and post 120, respectively. Connectors such as screws or nails and the like, can pass through the holes to connect one or more boards in the post channels to make a fence.

Figure 3D:
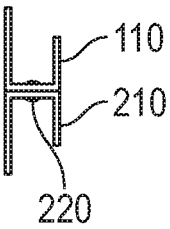
FIG. 3D is a diagrammatic illustration of a top view looking down the channels formed by joined J channel posts.

FIG. 3D is a cross-section view looking down the channels formed by joined J channel posts. Posts 110 and 210 are joined by connector 220.

Figure 4:
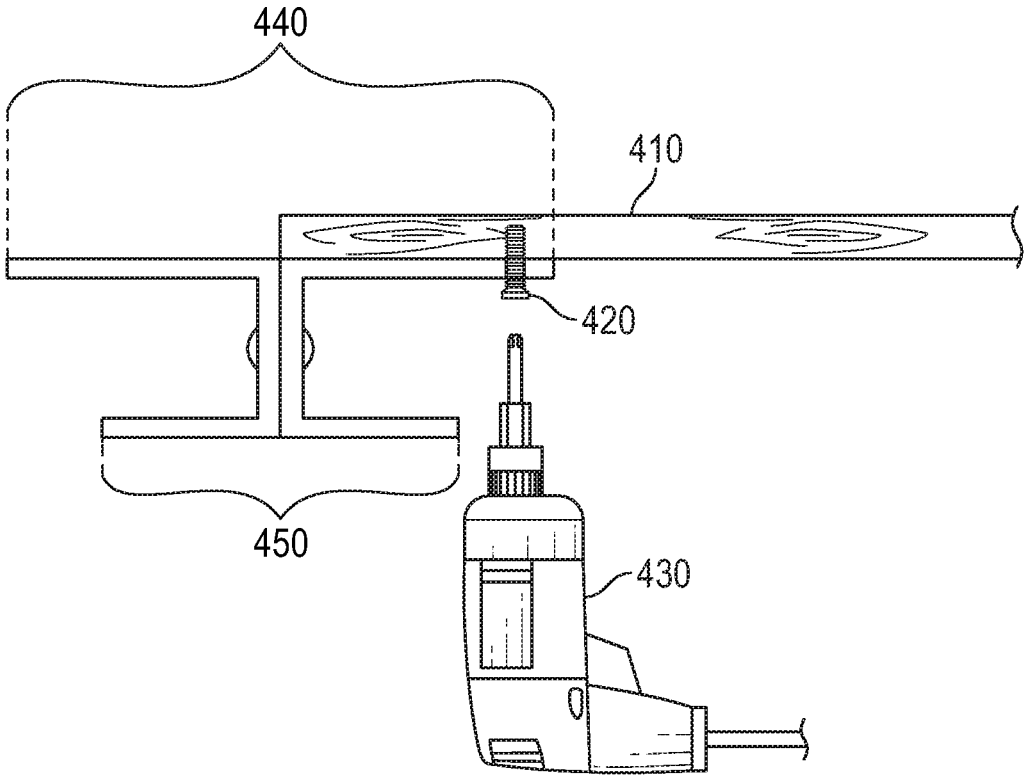
FIG. 4 is a top view diagrammatic illustration of a specific exemplary embodiment of the invention to illustrate an exemplary method for creating a horizontal wood fence where all fasteners are hidden from one side of the fence.

FIG. 4 is a top view diagrammatic illustration of a specific exemplary embodiment of the invention to illustrate an exemplary method for creating a horizontal wood fence where all fasteners are hidden from one side of the fence. Instead of, or in combination with, stacking boards in the post channel, boards can be attached to the exterior of the post with fasteners such as screws drilled through guide holes. The exterior boards hide the post and the connectors from view. FIG. 4 illustrates a method of constructing a "hidden fastener" fence where boards are affixed to the face of the post, and a drill is used to fasten screws to the boards from the other side, where clearance is provided to position the drill.

Wood board 410 is placed horizontally by fastening it to the post 440. Post 440 has a long face of the post and a short face 450. Board 410 is fastened to post 440 with screw fastener 420 using drill 430 for example. The drawing illustrates that a horizontal board can be fastened to the front face of the post 440 by drilling behind, where the face of 450 is narrow enough to give the drill clearance to drill the screw into the wood board. The resulting fence is a wood horizontal fence where all fasteners are completely hidden from one side.

Figure 5:
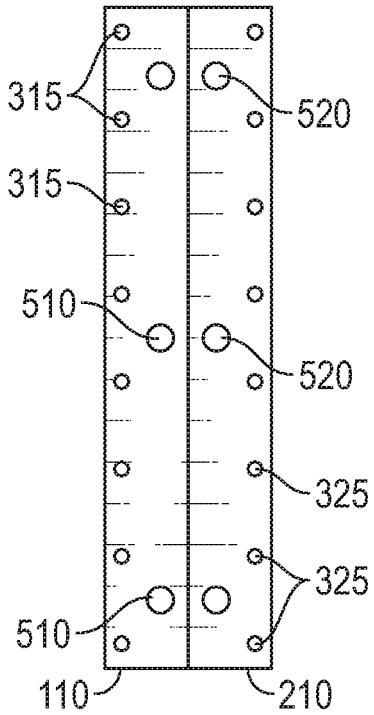
FIG. 5 is a side view diagrammatic illustration detail of a J channel arm of the present invention.

FIG. 5 is a side view detail of a J channel arm of the present invention. Posts 110, 210 are joined with one or more connectors, as for example weld beads or rivets 220, as described above. A plurality of drill guide holes 510 on post 110 and drill guide holes 520 on post 120 facilitate driving screws, such as screw 420, through the post into the fence board to connect the board to the post. In particular, drill guide holes 510, 520 are provided on long arm 140 of each respective post 110, 120 so that a drill bit or screw driver, for example, can pass through the long arm to drive a screw through a guide hole in the opposite short arm, as illustrated in FIG. 6A.

Figure 6A:
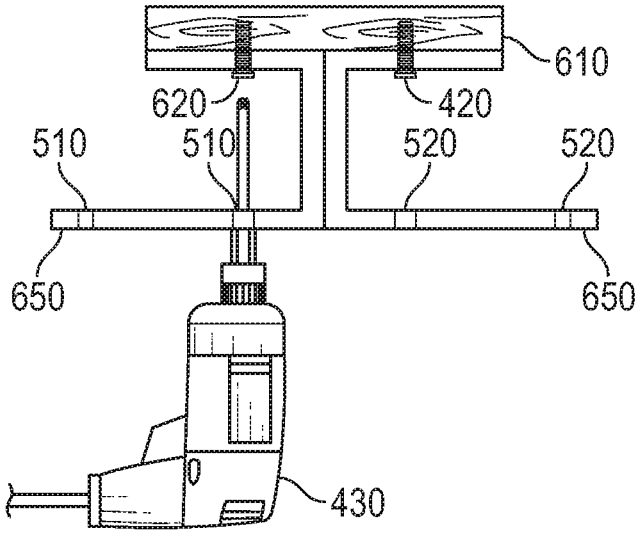
FIG. 6A is a top view diagrammatic illustration cross section of a method for constructing a fence of the present invention.

FIG. 6A is a top view cross section diagrammatic illustration of a method for constructing a fence of the present invention. Vertical board 610 or other suitable backing member is fastened to short arms of J channel post 650 with screw 420 and screw 620, for example, fastened with power tool 430 through enlarged guide holes 510, 520, such that vertical board 610 covers the fence post and is fastenless from the front for a seamless appearance.

Figure 6B:
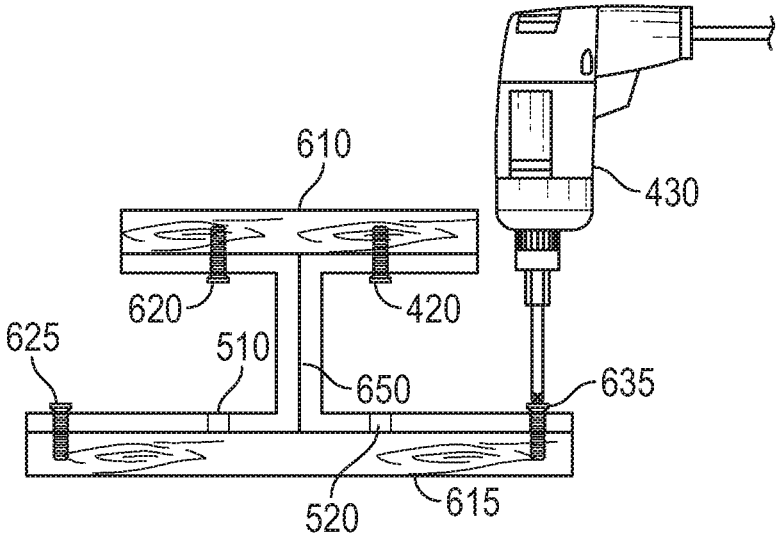
FIG. 6B is a top view diagrammatic illustration cross section of a method for constructing the fence of FIG. 6A.

FIG. 6B is a top view cross section of a method for constructing the fence of FIG. 6A. Horizontal board 615 is fastened to long arms of J channel post 650 with screw 625 and screw 635, for example, fastened with power tool 430 through guide holes 510, 520.

Figure 7:
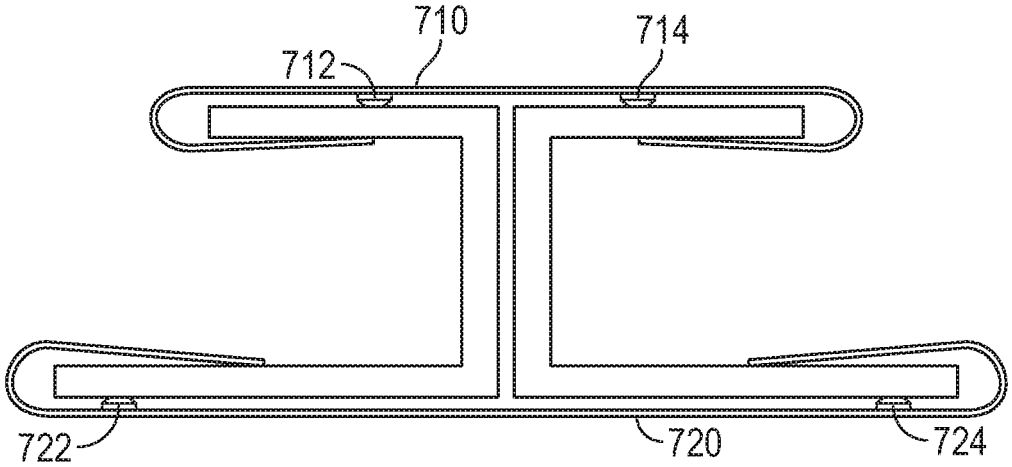
FIG. 7 is a top view diagrammatic illustration of a specific exemplary alternative embodiment of a fence of the present invention.

FIG. 7 is a top view of a specific exemplary alternative embodiment of a fence of the present invention. A decorative fence covering 710, 720 is shaped to have terminal end portions that curl back to form a clip structure. Coverings 710, 720 is attached to a fence of the present invention by sliding the curled end portions over the arms of a J channel post and then sliding cover 710, 720 down to a desired position. Covering 720 extends longer than covering 710 to accommodate the dimension of the long arms of the J channel post. Spacers 712,714 and 722, 724, are optional components that may be included in the fence structure to provide a uniformly flat covering surface. In specific alternative embodiments optional spacers 712,714 and 722, 724 are cushions. Spacers or cushions 712,714 and 722, 724 might be useful, for example, when the fence board surface over which a decorative cover is placed is uneven and spacers would provide a uniformly flat covering surface over an underlying uneven surface.

Figure 8:
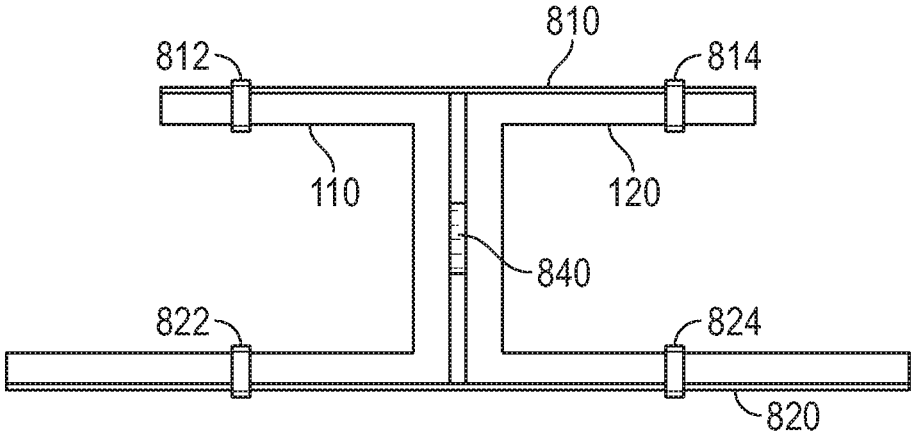
FIG. 8 is a top view diagrammatic illustration of another specific exemplary alternative embodiment of a fence of the present invention.

FIG. 8 is a top view of another specific exemplary alternative embodiment of a fence of the present invention. In the embodiment of FIG. 8, decorative covering 810, 820 is fastened to J channels 110, 120 with clips 812, 814 on the short arms and clips 822, 824 on the long arms. Also illustrated is optional spacer or cushion 840 between J channel 110 and J channel 120 positioned at or near the joint that joins the J channels together.

Figure 9:
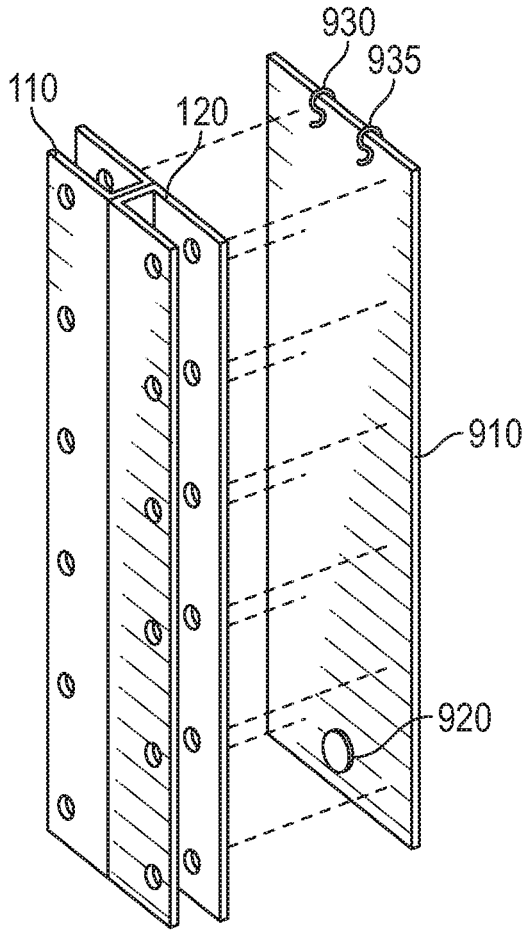
FIG. 9 is an exploded view diagrammatic illustration of yet another specific exemplary alternative embodiment of a fence of the present invention.

FIG. 9 is an exploded view of yet another specific exemplary alternative embodiment of a fence of the present invention. Decorative cover 910 is fastened to joined J channels 110, 120 with S-clips 930, 935 at the top and by magnet 920 at the bottom.

Figure 10:
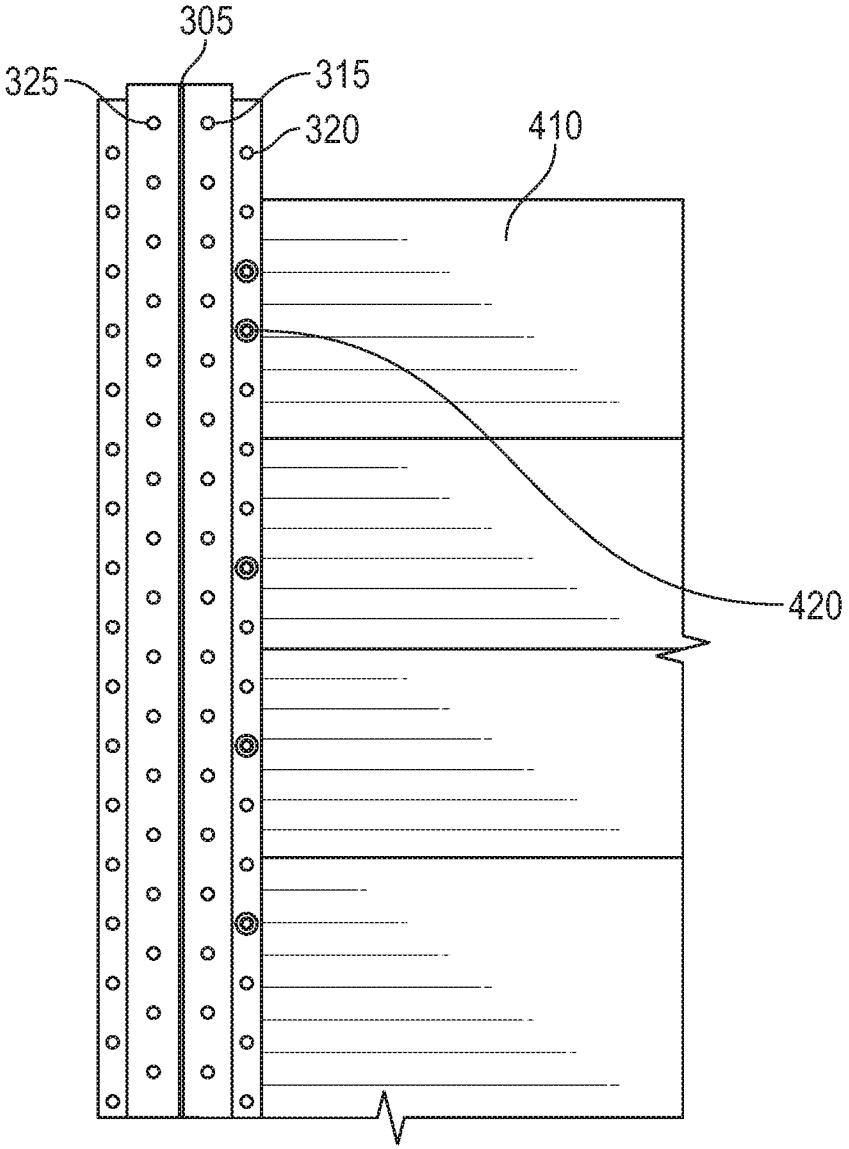
FIG. 10 is a rear view diagrammatic illustration of a partially completed fence of FIG. 4.

FIG. 10 is a rear view diagrammatic illustration of a partially completed fence of FIG. 4. The shorts arms of post 305 with guide holes 315, 325 are in the foreground and the long arms with guide holes 320 are behind the short arms. Board or backing member 410 is mounted in the rear to post 305 with screws 420 through a corresponding guide hole 320. A plurality of boards 410 are stacked and fastened to post 305 in the fashion.

Figure 11:
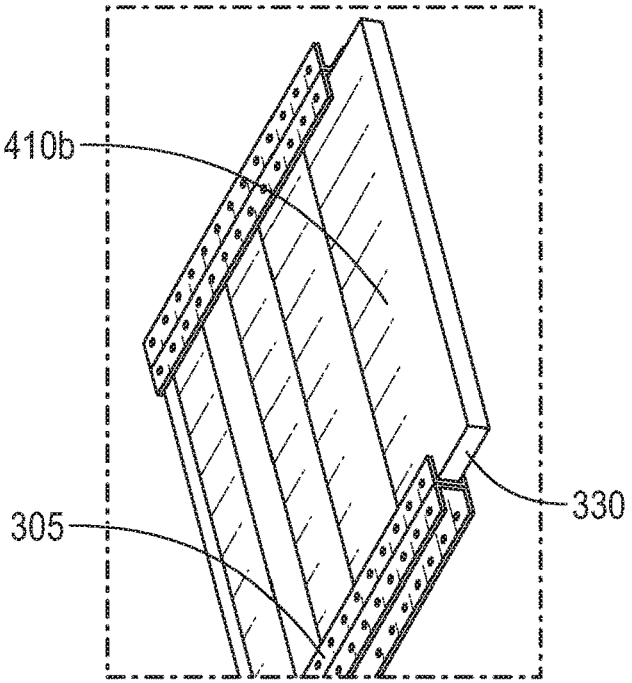
FIG. 11 is an isometric perspective rear view diagrammatic illustration of the fence of FIG. 10 more completed.

FIG. 11 is an isometric perspective rear view diagrammatic illustration of an alternative specific embodiment of fence of the present system. In the embodiment of FIG. 11, boards 410*b* are horizontally stacked in channel 330 of post 305 at a first end and also in the channel of another matching post at a second end of the board.

Figure 12:
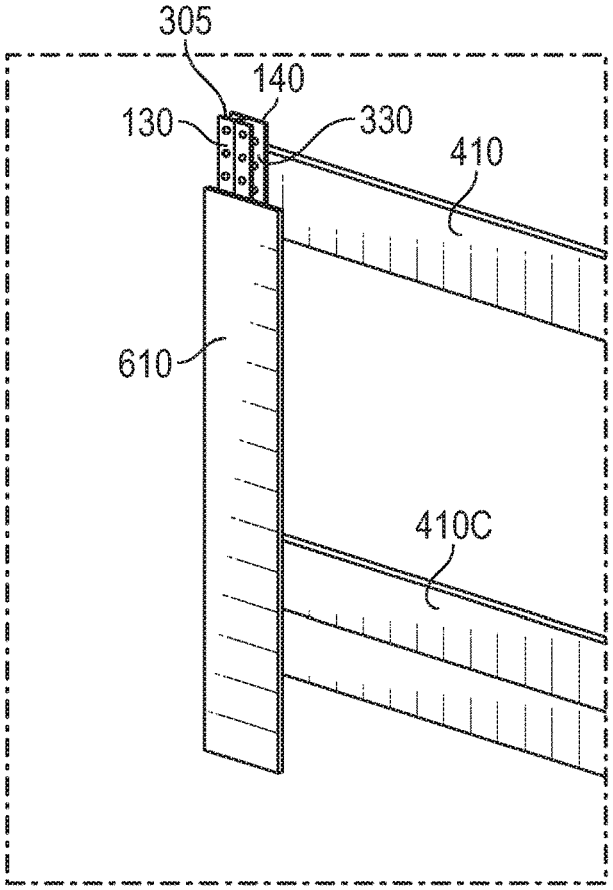
FIG. 12 is an isometric perspective front view diagrammatic illustration of the fence of FIG. 10 with hidden post.

FIG. 12 is an isometric perspective front view diagrammatic illustration of the fence of FIG. 10 with hidden post. In the illustration of FIG. 11, the posts 305 are not hidden. The posts 305 can be selectively hidden, however, by attaching a decorative cover or board to the posts using drill guide holes 510 or 520 in long arm 140 through screw guide holes in short arm 130, as necessary, to attach a covering member 610 such as a vertical board. Also illustrated are examples of stacked horizontal back members 410*c* mounted to the rear side of post 305 to provide the fencing.

Figure 13:
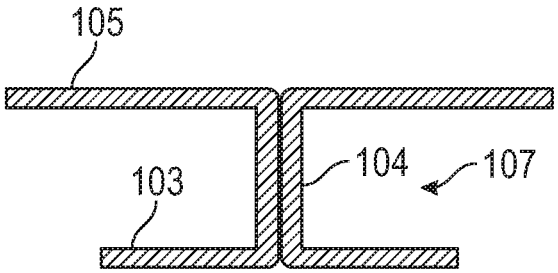
FIG. 13 is a top view diagrammatic illustration of an alternative specific embodiment of a J-channel post of the present system

FIG. 13 is a top view diagrammatic illustration of an alternative specific embodiment of a J-channel post of the present system. The embodiment of FIG. 13 is a dual J-channel post as described above except that post 305 is a unitary piece of extruded and shaped aluminum. Sort arm side 103 is connected to long arm side 105 by connector segment 104. Channel 107 is formed between short arm 103 and long arm 105 with a complimentary channel formed on the other side of connector segment 104.

Figure 14:
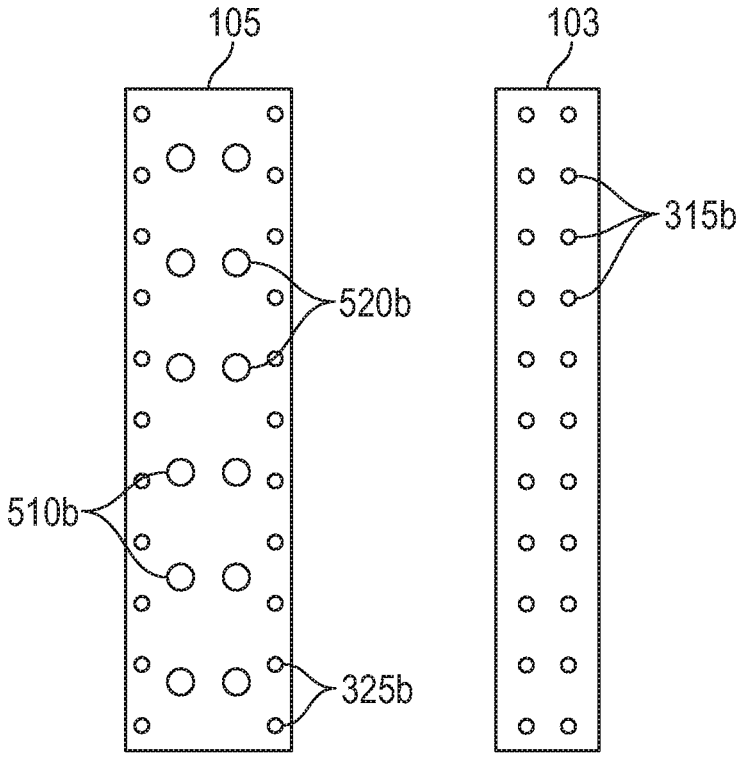
FIG. 14 is a side view diagrammatic illustration of the post of FIG. 13.

FIG. 14 is a side view diagrammatic illustration of the post of FIG. 13. Screw guide holes 525*b*, together with drill guide holes 510*b*, 520*b* are machined through long arm side 105. Screw guide holes 315 are machined through short arm side 103.

Disclosed is a metal fence post, which is made up of the following components: two J Channel metal posts, with one or more holes. These components are connected as follows: the two J Channel metal posts are positioned back to back and permanently fastened, such that a single metal post is created, with a first face and a second face wider than the first face, and two channels in between. One or more holes are punched into the metal post.

The device may also have one or more of the following: (1) a selection of holes along the vertical length of each side, (2) a selection of holes along the vertical length of each side that are alternating in position such that holes on the front face are offset from holes from the second face, and (3) decorative strips that attach over the post to conceal the post and fasteners, which are fastened to the post.

The disclosed device is advantageous when compared with other known devices and solutions because it provides: (1) an easy method to create a horizontal wood fence by placing horizontal boards in the channels between two posts; (2) where the post and channel can easily be hidden with a decorative panel that fastens to the metal post or alternatively, a thin piece of wood; (3) avoids any secondary wood support boards which can rot and decay; where such post can also be used to create a horizontal wood fence with completely hidden fasteners by placing the wood board on the front face of the post and fastening from behind. Similarly, the associated method to make the post is advantageous in that it: (1) creates the post by fastening two J channel posts back to back; (2) creates an optional decorative panel that hides the post but easily fastens to the post through a clip.

The present fencing system provides a modular channeled fencing system consisting of two or more dual channeled posts. Each of the dual channeled posts has a long arm side and a short arm side and each long arm side and short arm side has one or more guide holes. A plurality of mounting connectors sized to fit in the one or more guide holes are used to fasten fencing boards to the posts. The dual channeled posts can be formed by joining two single channel J posts or can be a unitary piece formed from extruded aluminum. One or more backing members can be modularly and selectively mounted to the long arm side, the short arm side or disposed in one or more channels of the dual channels of the post.

The disclosed device is advantageous when compared with other known devices and solutions because it provides: (1) an easy method to create a horizontal wood fence by placing horizontal boards in the channels between two posts; (2) where the post and channel can easily be hidden with a decorative panel that fastens to the metal post or alternatively, a thin piece of wood; (3) avoids any secondary wood support boards which can rot and decay; where such post can also be used to create a horizontal wood fence with completely hidden fasteners by placing the wood board on the front face of the post and fastening from behind. Similarly, the associated method to make the post is advantageous in that it: (1) creates the post by fastening two J channel posts back to back; (2) creates an optional decorative panel that hides the post but easily fastens to the post through a clip.

The disclosed device is advantageous in that it is structurally different from other known devices or solutions. More specifically, the device is advantageous due to the presence of: (1) front face (2) a back face that is wider than the front face and (3) two channels created between the front face and back face.

Furthermore, the process associated with the aforementioned apparatus is likewise advantageous. More specifically, the disclosed process owes its advantages to the fact that it is created by forming two J channels out of metal and then fastening those J Channels back to back with rivets or welding. This is unique because the resulting shape—an unequal I beam shape—cannot be easily created directly out of metal unless it is made by directly extruding hot metal. This is a very difficult process for steel. The disclosed method for manufacturer allows existing strips of preformed metal to be simply shaped and then fastened.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

I claim:

1. A channeled fencing system, the system comprising:

2 or more J-channeled posts, each J-channel post having one or more guide holes and comprising a long arm and a short arm, and each of the 2 or more J-channel posts being connected to form a dual channeled unitary post such that the short arms are on a first side and the long arms are on a second side;

a plurality of mounting connectors sized to fit in the guide holes;

one or more backing member upon which the 2 or more J-channeled posts are mountable to the joined J-channel posts with the mounting connectors; and one or more decorative covering that attach over the 2 or more J-channel posts to conceal the J-channel posts and mounting connectors which are fastened to the posts.

2. The channeled fencing system of claim 1, wherein the 2 or more J-Channeled posts comprise metal.

3. The channeled fencing system of claim 2, wherein the 2 or more J-channeled posts are connected by one or more screws.

4. The channeled fencing system of claim 2, wherein the 2 or more J-channeled posts are connected by one or more weld beads.

5. The channeled fencing system of claim 1, wherein the fencing system has a front side and the mounting connectors are concealed from the front side.

6. The channeled fencing system of claim 1, further comprising one or more decorative covering that attach over the 2 or more J-channel posts to conceal the J-channel posts and mounting connectors which are fastened to the posts.

7. The channeled fencing system of claim 1, wherein the decorative covering is attached by one or more clips.

8. The channeled fencing system of claim 1, wherein the decorative covering is shaped to form a clip that clips onto the posts.

9. The channeled fencing system of claim 1, wherein a decorative covering attachment means comprises one or more magnets.

10. The channeled fencing system of claim 1, wherein the 2 or more J-Channeled posts comprise a non-metallic material.

11. The channeled fencing system of claim 1, further comprising and wherein the unitary post is a unitary piece.

12. The channeled fencing system of claim 11, wherein the unitary piece is formed from extruded aluminum.

13. A channeled fencing system, the system comprising:

2 or more vertical J-channeled posts, each J-channel post having one or more guide holes and comprising a long arm and a short arm, and each of the 2 or more J-channel posts being connected to form a dual channeled unitary post such that the short arms are on a first side and the long arms are on a second side;

a plurality of mounting connectors sized to fit in the guide holes, one or more backing member upon which the 2 or more J-channeled posts are mountable to the joined J-channel posts with the mounting connectors; and one or more decorative coverings that attach over the 2 or more vertical J-channel posts to conceal the J-channel posts and mounting connectors which are fastened to the posts.

* * * * *